United States Patent [19]

Hallinger et al.

[11] Patent Number: 4,623,298

[45] Date of Patent: Nov. 18, 1986

[54] TURBINE SHROUD SEALING DEVICE

[75] Inventors: Claude C. Hallinger, Vaux-le-Penil; Alain M. J. Lardellier, Melun, both of France

[73] Assignee: Société Nationale d'Etudes et de Construction de Moteurs d'Aviation, Paris, France

[21] Appl. No.: 652,475

[22] Filed: Sep. 20, 1984

[30] Foreign Application Priority Data

Sep. 21, 1983 [FR] France ..... 83 14974

[51] Int. Cl.[4] ..... F01D 11/02

[52] U.S. Cl. ..... 415/139; 415/174

[58] Field of Search ..... 415/174, 138, 139, 134, 415/135, 136, 137, 172 A, 173 R

[56] References Cited

U.S. PATENT DOCUMENTS

| | | | |
|---|---|---|---|
| 2,510,734 | 6/1950 | Bodger | 416/190 |
| 2,997,275 | 8/1961 | Bean et al. | 415/135 |
| 3,532,437 | 10/1970 | Strub | 415/136 |
| 3,867,061 | 2/1975 | Moskowitz | 415/174 |
| 3,986,789 | 10/1976 | Pask | 415/139 |
| 4,076,455 | 2/1978 | Stargardter | 416/191 |
| 4,272,290 | 6/1981 | Lesgourgues | 415/174 |
| 4,295,785 | 10/1981 | Lardellier | 415/174 |
| 4,346,904 | 8/1982 | Watkins, Jr. | 415/174 |

FOREIGN PATENT DOCUMENTS

| | | |
|---|---|---|
| 1816066 | 8/1969 | Fed. Rep. of Germany . |
| 1331030 | 5/1963 | France . |
| 1519898 | 2/1968 | France . |
| 2514409 | 10/1981 | France . |
| 91210 | 1/1920 | Switzerland . |
| 2072760 | 10/1981 | United Kingdom . |

OTHER PUBLICATIONS

Seals for Rotating Shafts, Dr. E. S. Moult, Sep. 1975, pp. 727–731 *Engineering.*

*Primary Examiner*—Everette A. Powell, Jr.
*Attorney, Agent, or Firm*—Bacon & Thomas

[57] ABSTRACT

An improved guide vane shroud sealing device is disclosed wherein the shroud is formed from a plurality of segments, each segment having interengaging, "Z" shaped edges. The "Z" edges each have a mid-portion extending parallel to the rotational plane of a rotor blade wheel, and leading and trailing edge portions extending from this mid-portion to the leading and trailing edges of the shroud segments. A honeycomb packing structure seals the inner surface of the guide vane shroud in conjunction with labyrinth sealing fins on the rotor wheel. The honeycomb structure is oriented such that opposite sides of each cell which are joined to adjacent cells extend at an angle of approximately 60° to the rotational plane of the rotor blade wheel.

3 Claims, 6 Drawing Figures

TURBINE SHROUD SEALING DEVICE

BACKGROUND OF THE INVENTION

1. Field of the Invention

The instant invention relates to an improved device for effecting a seal between a stationary guide vane structure and a rotor blade wheel.

2. Brief Description of the Prior Art

French Pat. No. 1,331,030 discloses a compressor vane ring wherein the individual vanes are fastened to inner and outer rings. The outer ring is formed by a plurality of arcuate segments having overlapping ends which are welded together. The overlapping portions serve as reinforcing ribs to increase the strength of the guide vane structure.

French Pat. No. 1,519,898 describes a rotor blade system wherein an outer ring connecting the blades is formed from a plurality of segments, each segment having generally "Z" shaped end portions. The end portions of one segment contact end portions of an adjacent segment at a mid-portion, while the portions on either side define a gap therebetween. The untwisting of the blades during their operation is utilized to provide a continuous connection between the blade segments on the rotor wheel.

French Pat. No. 2,514,409 discloses a rotor blade system wherein the blade wheel is formed from a plurality of segments. The inner, base portion of the segment is attached to a rotor disc, while the outer portion of the segment, which interconnects the tips of the blades, are interconnected by sealing means to prevent fluid leakage past the joint between adjacent segments. The sealing is affected by plate members inserted in correspondingly aligned slots in the ends of each segment.

The main object of the prior art in using the "Z" shape at the ends of the segments is to achieve a rigid and continuous connection between adjacent blades or blade segments when these are subjected to centrifugal action. Little, if any, consideration has been given to reducing the leakage of the gas passing across the turbine blades in a radial direction at the juncture of these segments, when the "Z" configuration is utilized.

SUMMARY OF THE INVENTION

The instant invention discloses a system for improving the seal between a guide vane shroud formed from a plurality of guide vane shroud segments and the rotating parts of the turbine assembly. This is accomplished by utilizing a specifically shaped "Z" geometry on each of the ends of the guide vane shroud segments which allows thermal expansion of the respected segments and at the same time avoids deleterious vibrations. Sealing means are provided between adjacent guide vane shroud segments to minimize radial leakage. A honeycomb-type labyrinth type seal is provided on the radially innermost sides of the guide vane shroud adjacent a labyrinth sealing fin extending from the rotor wheel structure. The honeycomb labyrinth seal is formed such that each of the hexagonal cells has two opposite sides joined to adjacent cells and is oriented in the turbine structure such that these opposite sides lie in parallel planes extending at an angle of approximately 30° to the rotational plane of the rotor blade wheel.

The "Z" shaped ends of each of the guide vane segments comprises a mid-portion, which extend generally parallel to the rotational plane of the rotor blade wheel, a leading edge portion which extends from the mid-portion to a leading edge of the segment, and a trailing edge portion which extends from the mid-portion to a trailing edge of the segment. Sealing plates may be installed in aligned slots such that it extends between trailing edge portions of each segment to minimize radial leakage.

DETAILED DESCRIPTION OF THE PREFERRED EMBODIMENT

Figure 1:
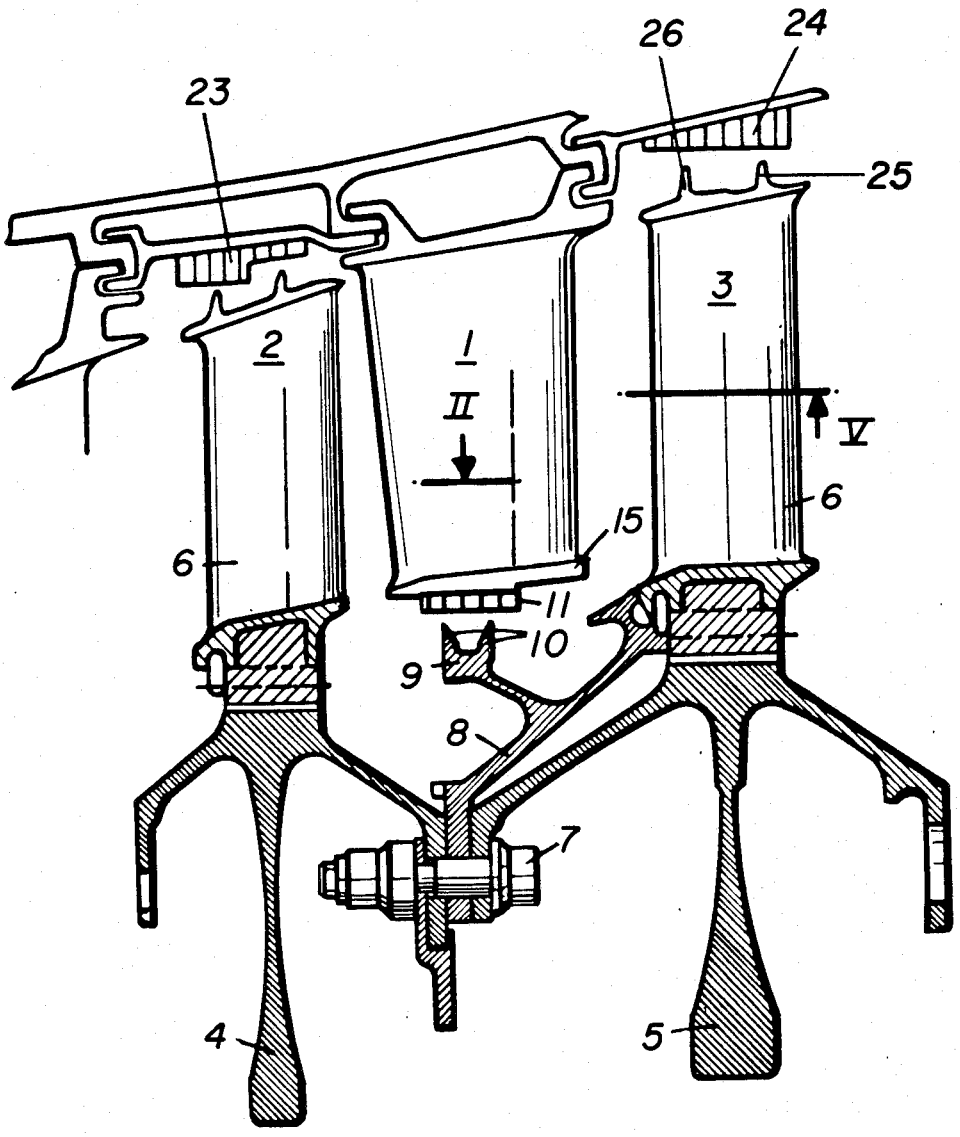
FIG. 1 is a partial, side sectional view of a turbine utilizing the shroud sealing device according to the invention.

FIG. 1 shows a partial, sectional view of a turbine having an outer housing, a fixed guide vane stage 1 and a pair of rotor blade stages 2 and 3 located on either side of the fixed guide vane stage. Each of the rotor blade stages comprise a plurality of turbine blades 6 attached to rotor wheels 4 and 5, respectively, by known means. These are retained within the housing so as to rotate about a common, rotational axis which extends generally parallel to the longitudinal axis of the housing. Rotor blade wheels 4 and 5 are attached to each other by bolts 7 extending through aligned flange structures associated with each wheel. A seal is provided between the radially innermost end portion of the guide vane stage 1 and the rotating turbine wheels 4 and 5 by labyrinth seal means 9 rigidly affixed to supporting flange 8. Labyrinth seal means 9 has a plurality of radially extending, labyrinth seal fins 10 extending therefrom which interact with honeycomb-type labyrinth seal packing 11, to be described in more detail hereinafter. Honeycomb packing structure 11 is affixed to inner ring 15 which interconnects the innermost ends of the guide vanes 14 in stage 1.

Figure 2:
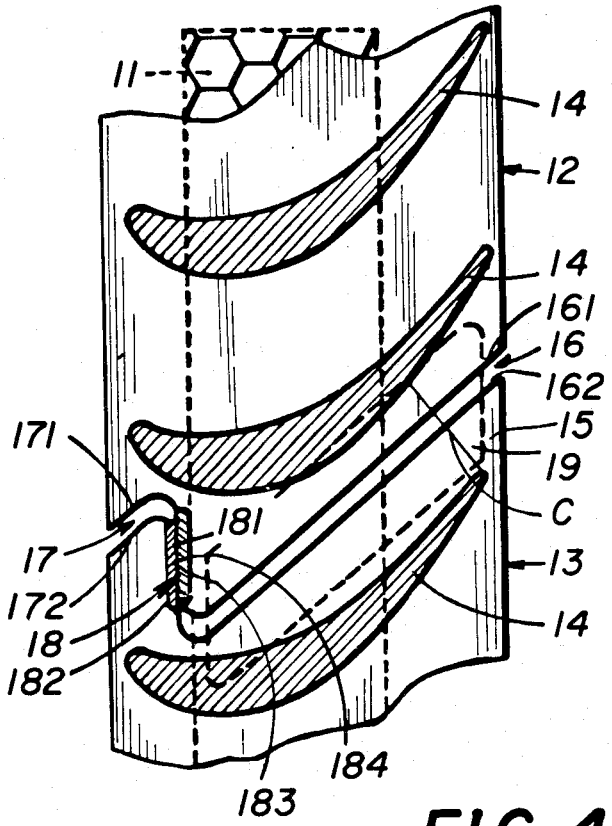
FIG. 2 is a partial sectional view in the direction of II in FIG. 1.

As best seen in FIG. 2, the guide vane stage 1 comprises a plurality of guide vane shroud segments each having a plurality of stationary guide vanes 14, an inner ring 15 and an outer ring (not shown). The outer ring is also attached to the turbine housing as shown in FIG. 1, to fixedly support the guide vane stage therein. FIG. 2 shows the intersection of adjacent guide vane segements 12 and 13, each formed with a generally "Z" shaped edge. As shown in this figure, each of the "Z" shaped edges comprises a mid portion 181 and 182, a leading edge portion 171 and 172 which extends from the respective mid portion to a leading edge of each of the segments, and a trailing edge portion 161 and 162, which extends from the mid-portion to a trailing edge of each segment. Mid-portions 181 and 182 extend generally parallel to the plane of rotation of the rotor wheels 4 and 5, respectively, and contact each other along line 18. This arrangement prevents the adjacent guide vane segments from moving axially with respect to each other, but does not prevent circumferential displacements due to thermal expansion and contraction.

Vibrations from both the air flow through the guide-vane stage and the rotation of the compressor stages may cause mid portions 181 and 182 to prematurely wear thereby affecting the sealing capacity between the guide vane segments. In order to minimize this possibility, mid portions 181 and 182 may be covered by a wear-resistant material, such as a cobalt-based alloy. This material may be in the form of small plates 183 and 184 welded to the respective contacting surfaces.

In their normal configuration, trailing edge portions 161 and 162 are separated by a gap 16. Similarly, leading edge portions 171 and 172 are separated by a gap 17. Gaps 16 and 17 allow the circumferential expansion and contraction due to the normal changes in operating temperatures encountered in the turbine. Leading edge portions 171 and 172 extend at an acute angle from the respective mid-portions, as do trailing edge portions 161 and 162. As noted in FIG. 2, the trailing edge portions 161 and 162 are substantially longer than the leading edge portions 171 and 172. The trailing edge portions may extend from an upstream edge of labyrinth seal structure 11 to the trailing edge of the guide vane segment. Leading edge portion 171 may also extend parallel to trailing edge portion 161. A similar relationship may exist between leading edge portion 172 and trailing edge portion 162. The substantially longer length of the trailing edge portions permits the use of sealing plate 19 between adjacent segments to minimize radial leakage between them. The adjacent edges of guide vane segments 12 and 13 define aligned grooves into which the sealing plate 19 extends. The sealing plate is slidably retained in the groove to allow thermal expansion and contraction of the adjacent segments 12 and 13. The only portion of the juncture of adjacent guide vane segments which is not positively sealed is gap 17 between the leading edge portions 171 and 172. Since this extends for only a very short distance and is upstream from the intake of the guide vane system, it does not cause substantial perturbations in the air flow.

Figure 3:
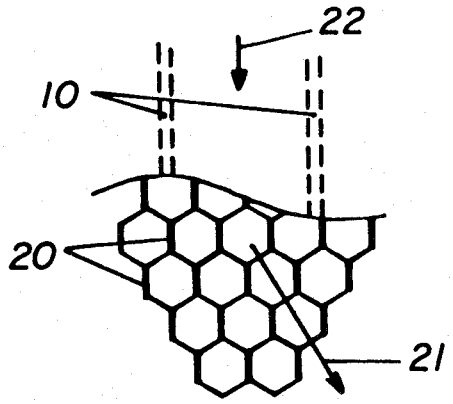
FIG. 3 (PRIOR ART)
FIG. 3 is a partial view, also taken in the direction of arrow II in FIG. 1 showing the orientation of the honeycomb seal according to the prior art.
Figure 4:
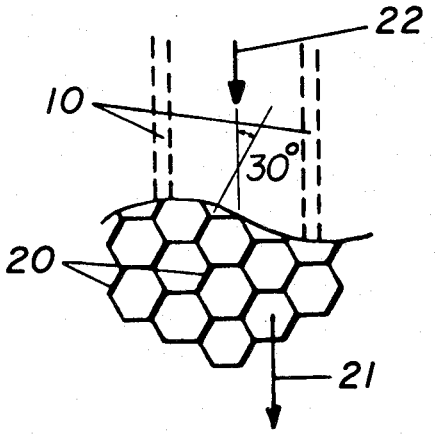
FIG. 4 is a partial view viewed in the direction of arrow II in FIG. 1 similar to FIG. 3, but showing the orientation of the honeycomb seal according to the present invention.

The labyrinth seal means comprises a honeycomb packing structure 11 fastened to the innermost side of the inner ring 15 of the guide vane structure. As is well known in the art, the honeycomb packing structure may be formed by welding, brazing, or otherwise bonding a plurality of crimped metallic strips to form a honeycomb structure with a plurality of hexagonally shaped cells. The metal may be a stainless steel or other high-temperature alloy to withstand the operational temperatures of the turbine. As seen in FIGS. 3 and 4, each cell of the honeycomb packing structure 11 has two opposite sides 20 joined to adjacent cells so as to form the honeycomb structure. As noted specifically in FIGS. 3 and 5, in the prior art these opposite joined sides were oriented such that they extended generally parallel to the plane of rotation of the rotor wheels, as indicated by arrow 22. As a result of this orientation, a path of least resistance, denoted by arrow 21, extended in the direction of the walls which were of single thickness (i.e., not joined to adjacent walls) which subtended an angle of approximately 30° to the direction of rotation of arrow 22. Accordingly, the labyrinth sealing fins 10 when they contacted the honeycomb packing structure 11 would tend to follow the path 21 through the honeycomb and thereby create grooves in the honeycomb structure significantly wider than the width of the labyrinth sealing fins themselves. This resulted in eventual degradation of the sealing capacity of the labyrinth seal.

Figure 6:
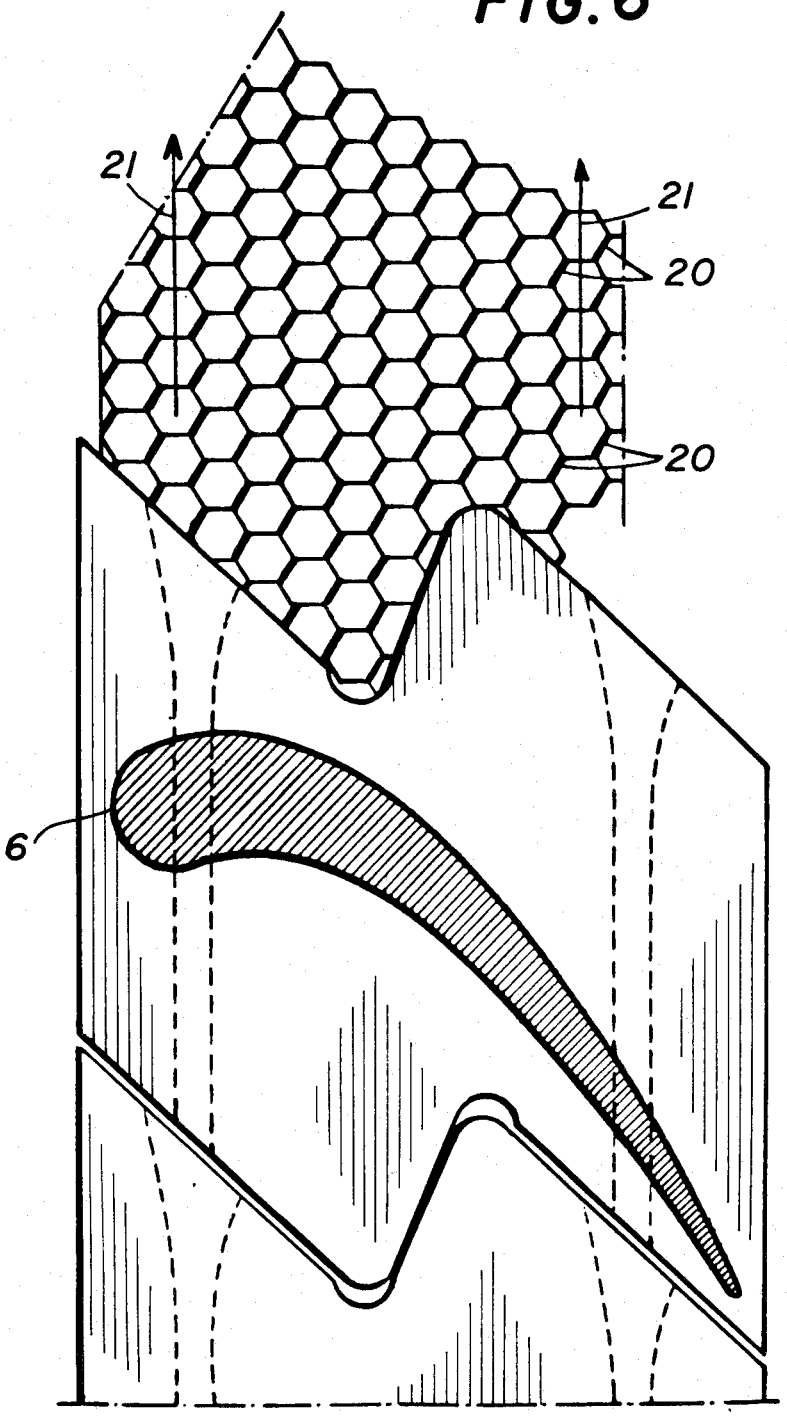
FIG. 6 is a partial, sectional view taken in the direction of arrow V in FIG. 1 showing the orientation of a honeycomb seal adjacent a rotor blade wheel according to the present invention.

In order to avoid this drawback, the instant invention proposes to orient the honeycomb packing structure such that the joined walls lie in parallel planes extending approximately at an angle of 30° with respect to the plane of rotation of the turbine wheels (and, of necessity, the labyrinth sealing fins 10). As shown in FIGS. 4 and 6, with this orientation, the path of least resistance 21 extends parallel to the rotational path of the turbine wheel, denoted by arrow 22. This minimizes the size of the groove in the honeycomb structure formed by the labyrinth sealing fins 10 and allows them to penetrate the honeycomb sealing structure with less stress. Thus, the sealing affect achieved by the labyrinth seal is more effective over a period of time.

Figure 5:
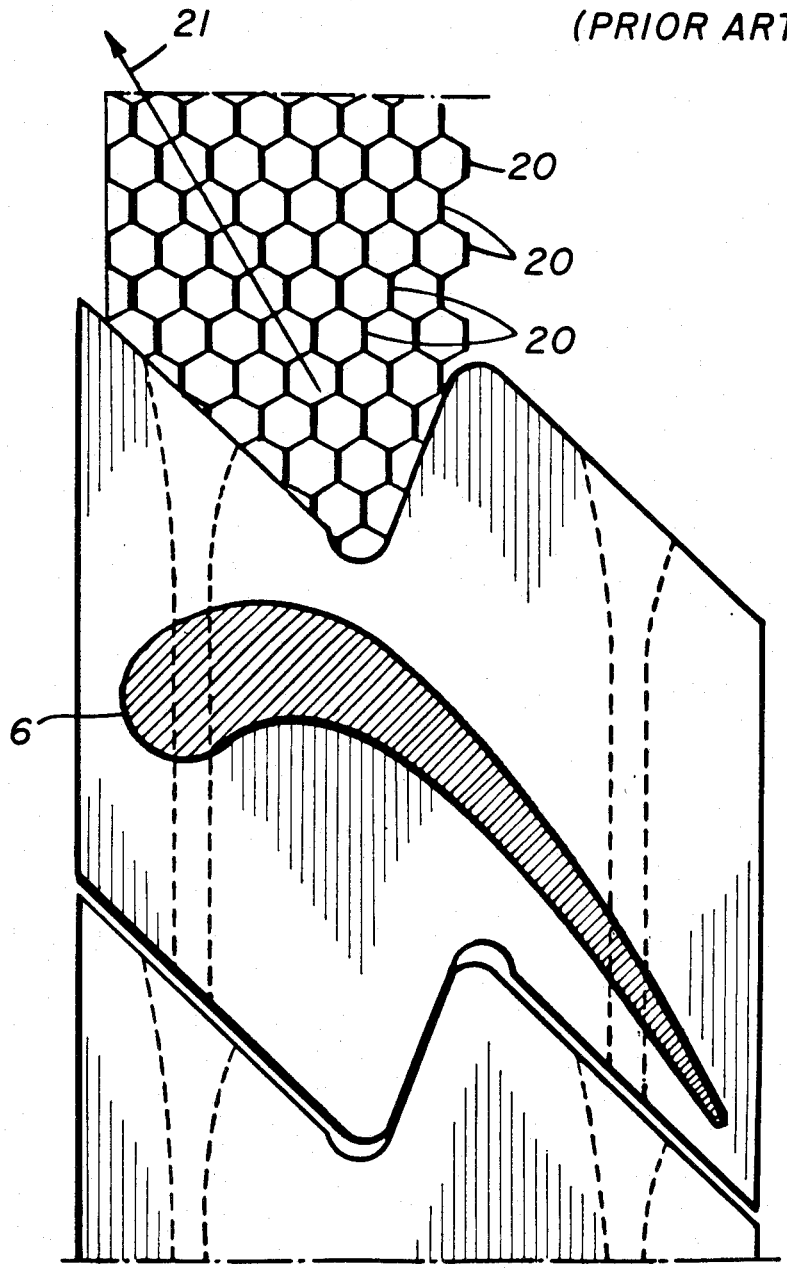
FIG. 5 (PRIOR ART)
FIG. 5 is a partial cross-sectional view taken in the direction of arrow V in FIG. 1 showing the orientation of a honeycomb seal adjacent the ends of rotor blades according to the prior art.

The same orientation of the honeycomb sealing structure may be utilized in external seals 23 and 24 to affect a seal between the tips of the rotor blades 6 and the engine housing. FIG. 5 shows the orientation of the prior art external seals wherein the joined walls of the honeycomb structure extend generally parallel to the plane of rotation. Again, labyrinth sealing fins 25 and 26 tend to follow the path of least resistance, denoted by arrow 21, thereby forming unnecessarily wide grooves in the honeycomb structure. By orienting the honeycomb structure such that the joined walls subtend an angle of approximately 30° with respect to the plane of rotation of the rotor blade wheels, as shown in FIG. 6, the path of least resistance, denoted by arrow 21, is parallel to the rotational plane of the rotor blade wheel.

The foregoing description is provided for illustrative purposes only and should not be construed as in anyway limiting this invention, the scope of which is defined solely by the appended claims.

What is claimed is:

1. In a turbine having an outer housing and at least one rotor blade wheel located within the outer housing having at least one labyrinth sealing fin extending radially therefrom, the improvements comprising:

(a) a plurality of guide vane shroud segments forming a guide vane shroud attached to the housing and located adjacent to the rotor blade wheel, each of the shroud segments having generally "Z" shaped ends on its radially inner ring, each such end having a mid-portion extending generally parallel to the rotational plane of the rotor blade wheel such that it contacts a corresponding mid-portion of an adjacent shroud segment, a leading edge portion extending at an acute angle from the mid-portion to a leading edge of the shroud segment and a trailing edge portion, longer than the leading edge portion, extending at an acute angle from the mid-portion to a trailing edge of the shroud segment, the leading and trailing edge portions of one segment being spaced apart from corresponding leading and trailing edge portions of adjacent shroud segments to allow for thermal expansion;

(b) a wear-resistant material attached to each mid-portion;

(c) seal means disposed between trailing edge portions of adjacent shroud segments; and, (d) labyrinth seal means disposed on the radially innermost side of the guide vane shroud adjacent to the labyrinth sealing fin, the labyrinth seal means comprising a honeycomb packing structure defining a plurality of hexagonal cells, each cell having two opposite sides joined to adjacent cells, such joined, opposite sides lying in parallel planes extending at an angle of approximately 30° to the rotational plane of the rotor blade wheel, the trailing edge portion extending approximately from an upstream edge of the labyrinth seal means to the trailing edge of the shroud segment.

2. The improved turbine of claim 1 wherein the wear-resistant material is a cobalt-based alloy.

3. The improved turbine of claim 1 further comprising second labyrinth seal means disposed on the turbine housing in the plane of rotation of the rotor blade wheel to effect a seal between the rotor blade tips and the housing, the second labyrinth seal means comprising a honeycomb packing structure defining a plurality of hexagonal cells, each cell having two opposite sides joined to adjacent cells, such joined opposite sides lying in parallel planes extending at an angle of approximately 30° to the rotational plane of the rotor blade wheel.

* * * * *

UNITED STATES PATENT AND TRADEMARK OFFICE

CERTIFICATE OF CORRECTION

PATENT NO. : 4,623,298

DATED : November 18, 1 986

INVENTOR(S) : HALLINGER et al

It is certified that error appears in the above-identified patent and that said Letters Patent is hereby corrected as shown below:

Column 2, line 60, "segements" should be "segments".

Signed and Sealed this

Twenty-eighth Day of April, 1987

*Attest:*

DONALD J. QUIGG

*Attesting Officer*

*Commissioner of Patents and Trademarks*